US005176469A

United States Patent [19]

Alsop

[11] Patent Number: 5,176,469

[45] Date of Patent: Jan. 5, 1993

[54] UNDERWATER SOIL RETENTION STRUCTURES

[75] Inventor: Peter Alsop, Kent, Great Britain

[73] Assignee: Hydracor International, Inc., Alexandria, Va.

[21] Appl. No.: 761,764

[22] PCT Filed: Feb. 21, 1990

[86] PCT No.: PCT/GB90/00272

§ 371 Date: Aug. 15, 1991

§ 102(e) Date: Aug. 15, 1991

[87] PCT Pub. No.: WO90/10113

PCT Pub. Date: Sep. 7, 1990

[30] Foreign Application Priority Data

Feb. 23, 1989 [GB] United Kingdom ..... 8904170

[51] Int. Cl.[5] ..... E02B 3/04

[52] U.S. Cl. ..... 405/24; 405/21; 405/17

[58] Field of Search ..... 405/15, 17, 21, 23, 405/24, 25, 28, 32

[56] References Cited

U.S. PATENT DOCUMENTS

| | | | |
|---|---|---|---|
| 4,437,786 | 3/1984 | Morrisroe | 405/24 |
| 4,534,675 | 8/1985 | Morrisroe | 405/24 |
| 4,722,639 | 2/1988 | Alsop | 405/25 |

FOREIGN PATENT DOCUMENTS

| | | |
|---|---|---|
| 88/05842 | 8/1988 | PCT Int'l Appl. . |
| 2127469 | 4/1984 | United Kingdom . |

*Primary Examiner*—David H. Corbin

*Attorney, Agent, or Firm*—Lowe, Price, LeBlanc & Becker

[57] ABSTRACT

An underwater soil retention and reinforcement structure comprises a sequence of synthetic buoyant fronds (11) arranged side-by-side to form a frond line. The frond line is folded back and forth to form an array of fronds, and the successive folded sections (14) of the frond line have aligned openings (20) threaded by at least one anchor line (19) for anchoring the array to the soil bed.

12 Claims, 2 Drawing Sheets

UNDERWATER SOIL RETENTION STRUCTURES

One of the most effective methods of preventing erosion of the river or sea bed around underwater structures is by anchoring an array or mat of synthetic buoyant fronds close to the structure. The fronds exert a viscous drag which reduces the velocity of the fines (soil particles) in underwater currents to a point where the particles are deposited, and the deposited particles then accumulate to form a permanent consolidated sandbank.

The array of fronds generally consists of lines of fronds arranged in a predetermined pattern and interconnected by flexible ties, or the fronds may be secured individually or in bunches to a matting.

In either case, the difficulties of manufacturing the array in a simple but cost-effective manner, combined with the difficulties of deploying the array on the river or sea bed, have prevented the potential of the method being fully exploited.

There is therefore the need for a soil retention and reinforcement structure which can be easily deployed on the sea bed, and which is simple to produce on a commercial scale. Ideally, the method of deploying the structure should lend itself to automation.

It would also be an advantage if the density and/or height of the structure could be easily varied over a wide range without affecting the manufacturing process.

According to one aspect of the present invention, there is provided an underwater soil retention and reinforcement structure comprising a sequence of synthetic buoyant fronds arranged side-by-side to form a frond line, the line being folded back and forth to form an array of fronds, and the successive folded sections of the frond line having aligned openings threaded by at least one anchor line for anchoring the array to the soil bed. In this manner, a curtain of fronds is presented to the soil particles in almost every direction, and the pitch or spacing between the successive folded sections is infinitely variable from a virtual solid to whatever pitch or spacing is required.

In a preferred embodiment, the structure comprises a fan-folded continuous sheet with vertical slits forming the individual fronds. The folded sheet is initially packed in a box-like dispenser with the folded sections in a tightly bunched, compact state. As the anchor line is withdrawn from the dispenser, the sections are spread apart.

In this manner, the density of fronds in the structure can be regulated simply by controlling the pitch of the folded sections. Moreover, since the frond line is a continuous folded structure, manufacture of a complete array of fronds is greatly simplified. A change in frond height is obtained merely by changing the width of the sheet.

The base of the sheet is preferably reinforced, and the anchor lines pass through aligned holes in the reinforced base section of the sheet.

One particular example of the invention will now be described with reference to the accompanying drawings in which.

Figure 1:
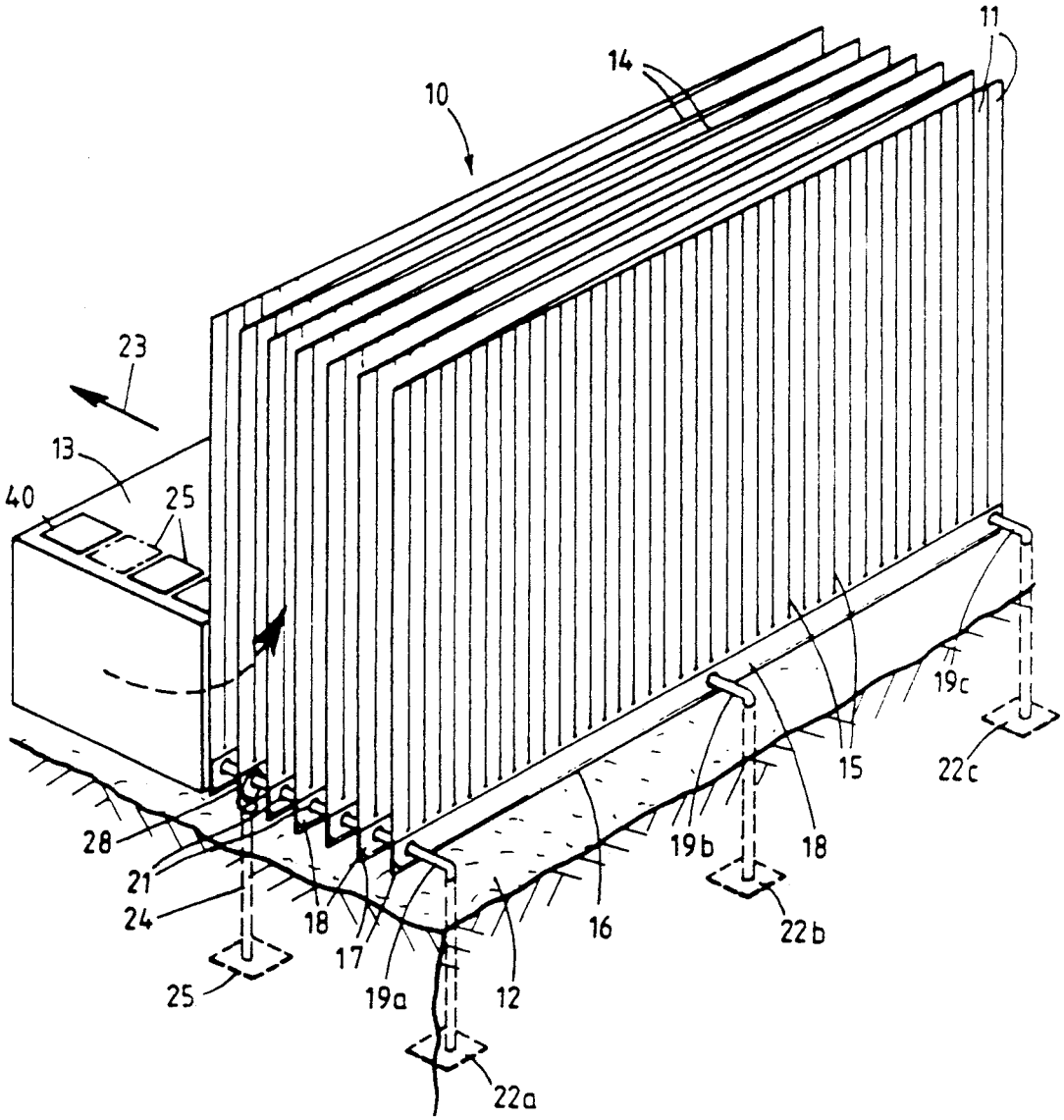
FIG. 1 is a diagrammatic perspective view showing a scour control structure partially withdrawn from a dispenser and anchored to the sea bed.

Referring to these drawings, the illustrated scour control structure consists of a continuous sheet 10 of buoyant synthetic material, such as polypropylene, slit into 25 mm vertical strips 11 to provide a sequence of individual fronds each having a height of up to 2 meters above the soil bed 12 when the structure is anchored to the bed 12.

The slits 15 terminate some distance above the bottom edge 16 of the sheet, and the bottom of the sheet is folded upwards to provide a reinforced base 18. A reinforcing strap 17 is encased within the base 18.

Figure 2:
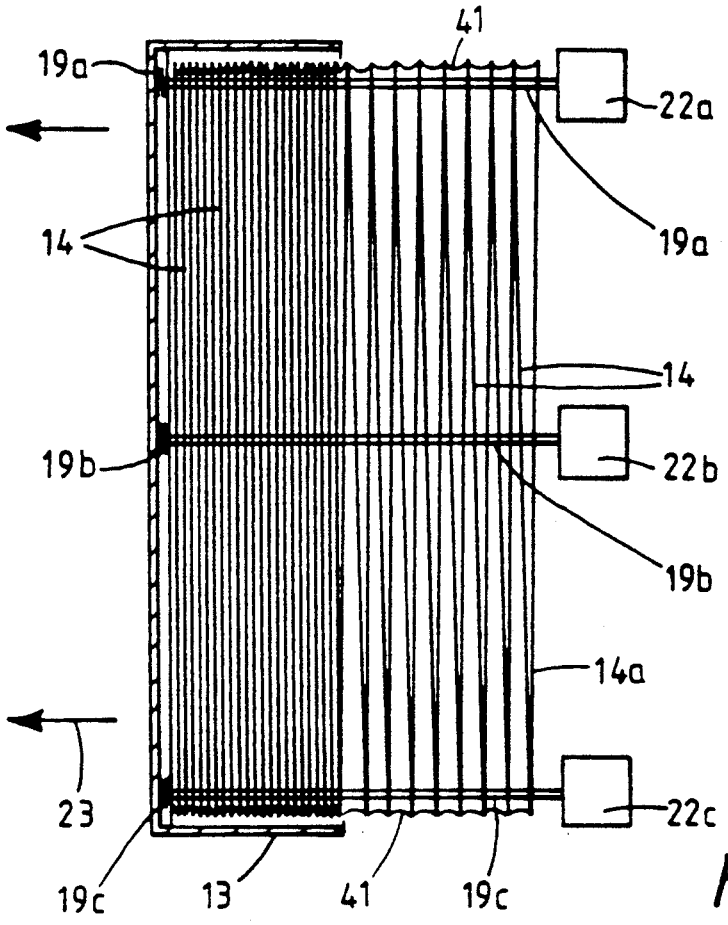
FIG. 2 is a diagrammatic underside plan view of the structure shown in FIG. 1.
Figure 3:
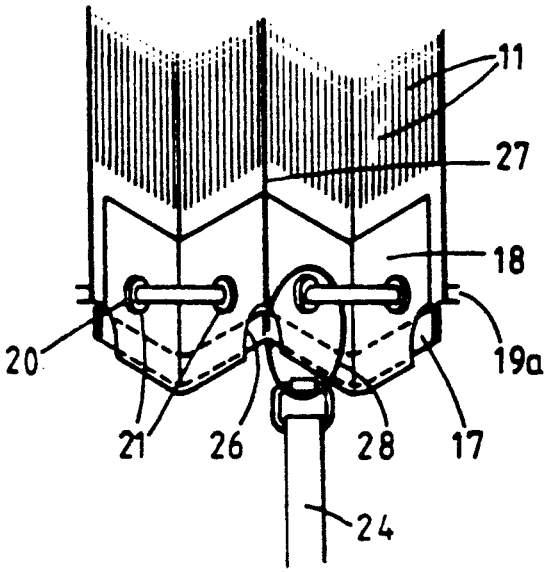
FIG. 3 is a detail of a part of the structure shown in FIG. 2 when viewed from one side and showing the attachment of a side anchor.

The sheet 10 is folded back and forth in a fan-folded configuration, and is dispensed from a box 13. As best shown in FIG. 2, the successive fan-folded sections 14 of the folded base strip 18 are stored at the bottom of the box 13 in a bunched compact state, and the frond strips 11 are then laid flat and folded over in the space above. As the sections 14 are progressively withdrawn from the box, the structure expands into an open extended state and the frond strips 11 are released into an upright buoyant position (FIG. 1).

The structure is threaded by anchor lines 19*a*, 19*b*, 19*c* passing through aligned holes 20 in the reinforced base 18. The lines 19 each carry adjustable sheet stops in the form of grommets 21 which are slidable along the respective lines and can be used to adjust the spacing between the fan-folded sections 14 of the sheet. This in turn controls the density of the fronds in the overall structure. Alternatively, a short foldable inter-sheet link 41 (FIG. 2) is provided between each of the successive sections 14 which limits the pitch of the fan-folded structure. The link may be of the same material as the sheet and effectively forms a V-shaped hinge between each of the successive sections 14 at the outboard edges of the structure as shown in FIG. 2.

The use of links 41 formed of sheet material permits a greater packing density in the dispenser 13 compared to the use of grommets 21, and controls the pitch of the fan-folded structure.

At the leading end of each line 19 is a ground anchor plate 22 which may be of the type more fully described in UK patent application 8904169.3. The anchor plates 22*a*, 22*b*, 22*c* are driven downwardly into the sea bed 12 to anchor the leading end of the structure 10 firmly to the sea bed.

These three leading anchors 22*a*, 22*b* and 22*c* are initially stored on top of the dispenser box 13. Once these three anchors have been anchored, the dispenser box 13 is advanced rearwardly in the direction of arrow 23. The leading section 14*a* of the fan-folded structure is attached to the anchor lines 19 so that this rearward movement progressively withdraws the successive sections 14 of the sheet 10 through a throat at the bottom of the front wall of the dispenser and opens out the fan-folded structure. During this process, the anchor lines 19*a*, 19*b*, 19*c* run through the openings 20 in the base of the fan-folded sheet, the three lines being drawn from respective supplies folded concertina fashion at the back of the dispenser as shown in FIG. 2. At predetermined intervals, denoted for example by colour coding on the anchor lines 19 and/or on the sheet 10, a side anchor 25 is secured to the respective outside anchor lines 19*a* and 19*c* by respective anchoring straps 24 and using a carabiner clip fastening 28 which clips around the anchor line and passes through an aperture 26 formed in the sheet 10 along one of the fold lines 27. Finally, three trailing anchors 40 secured by straps (omitted for the sake of clarity) to the opposite ends of the respective lines 19*a*, 19*b*, 19*c* are driven into the sea bed to complete the anchoring process.

With the structure 10 anchored to the sea bed in the path of an underwater current, the velocity of the current will be reduced below the critical transport velocity so as to ensure particle deposition. Accordingly, substantially all the fines carried by the current will be deposited within the structure and a permanent consolidated sandbank will be created having a particularly uniform distribution of reinforcement.

In particular, it can be seen that the fronds present an almost solid wall in every direction, and once the fines enter the V-shaped pockets formed by the successive sections of the folded sheet they are virtually trapped since there are no clear current flow paths through the structure.

The base pitch between successive sections might be of the order of 20 mm giving 50 frond lines per linear meter. This density can be easily varied by adjusting the spacing between the grommets 21. As illustrated, the grommets 21 are arranged so that the interleaved V-shaped pockets formed between the successive sections 14 extend from one side of the structure to the other in alternating directions. However the grommets 21 can be adjusted to provide any required pattern of pockets. In particular, the grommets on the centre anchor line 19*b* could be adjusted to provide a different pattern in which the pockets terminate at the centre line.

In the alternative arrangement of FIG. 2, the base pitch is fixed by the length of the foldable inter-sheet links 41.

The front anchor plate 22 and the side anchor plate 25 with their respective anchoring straps 24 are stored on top of the box 13 one behind the other so that they are easily accessible when deploying the structure on the sea bed.

I claim:

1. An underwater soil retention and reinforcement structure comprising a sequence of synthetic buoyant fronds arranged side-by-side to form a continuous line of fronds, the lines being folded back and forth to form a fanfold array of frond sections, each of the successive folded sections of the array having at least one aligned opening threaded by at least one anchor line for anchoring the array to the soil bed.

2. A structure according to claim 1 further comprising means for controlling the pitch or spacing between the successive folded sections of the frond array.

3. A structure according to claim 2 in which the control means comprises spacing elements slidable along the respective anchor lines.

4. A structure according to claim 2 in which the control means comprises foldable links between the successive folded sections.

5. A structure according to claim 1 in which a ground anchor is secured at one or both ends of each anchor line, the structure being anchored by driving the ground anchors into the soil bed.

6. A structure according to claim 5 further comprising means for releasably attaching at least one additional ground anchor to at least one of the anchor lines at a point intermediate the ends of the anchor line.

7. A structure according to claim 1 wherein the frond line comprises a continuous sheet of synthetic buoyant material.

8. A structure according to claim 7 wherein the anchor line is threaded through a reinforced base portion of the sheet.

9. A structure according to claim 8 in which the reinforced portion of the sheet comprises an upturned bottom edge.

10. A structure according to claim 9 in which a flexible reinforcing member is encased within the upturned bottom edge portion of the sheet.

11. A method of deploying an underwater soil retention and reinforcement structure, the structure comprising a line of buoyant fronds folded back and forth to form a fanfold array, the array being threaded by at least one transverse anchor line, the method comprising retaining each anchor line in a box-like dispenser with the fanfold sections of the frond line in a bunched, compact state, and the fronds lying flat, lowering the dispenser to the soil bed, anchoring one end of each anchor line to the soil bed, and thereafter advancing the dispenser over the soil bed such that the anchor line is progressively withdrawn from the dispenser and the fronds are released into an upright buoyant state.

12. A method according to claim 11 further comprising increasing the pitch or spacing between the successive folded sections of the frond array along the anchor line as the anchor line is withdrawn from the dispenser.

* * * * *